US009562724B2

(12) United States Patent
Arnot

(10) Patent No.: US 9,562,724 B2
(45) Date of Patent: Feb. 7, 2017

(54) HEAT-EXCHANGE APPARATUS FOR INSERTION INTO A STORAGE TANK, AND MOUNTING COMPONENTS THEREFOR

(76) Inventor: Roger Arnot, Abbotsford (CA)

( * ) Notice: Subject to any disclaimer, the term of this patent is extended or adjusted under 35 U.S.C. 154(b) by 267 days.

(21) Appl. No.: 13/808,858

(22) PCT Filed: Jul. 5, 2011

(86) PCT No.: PCT/CA2011/000784

§ 371 (c)(1),
(2), (4) Date: Apr. 19, 2013

(87) PCT Pub. No.: WO2012/003577

PCT Pub. Date: Jan. 12, 2012

(65) Prior Publication Data

US 2013/0199761 A1 Aug. 8, 2013

(30) Foreign Application Priority Data

Jul. 5, 2010 (CA) ..... 2706817

(51) Int. Cl.
*F28D 7/12* (2006.01)
*F28D 1/02* (2006.01)
(Continued)

(52) U.S. Cl.
CPC ..... *F28D 7/12* (2013.01); *B21D 53/02* (2013.01); *F28D 1/0213* (2013.01); *F28F 1/36* (2013.01);
(Continued)

(58) Field of Classification Search
CPC ..... B12D 53/02; F28D 1/0213; F28D 7/12; F28F 99/00; F28F 1/36; Y10T 29/49948; Y10T 29/49833
(Continued)

(56) References Cited

U.S. PATENT DOCUMENTS 1,835,323 A 12/1931 Olson et al.
2,243,593 A * 5/1941 Zallea ..... 165/142
(Continued)

FOREIGN PATENT DOCUMENTS

CA 2706817 7/2007
GB 1253025 11/1971
(Continued)

OTHER PUBLICATIONS

PCT/CA2011/000784—Notification Concerning Transmittal of International Report on Patentability (Chapter 1 of the Patent Cooperation Treaty).

*Primary Examiner* — Allana Lewin Bidder
*Assistant Examiner* — Raheena Rehman
(74) *Attorney, Agent, or Firm* — Palmer IP Inc.

(57) ABSTRACT

A heat-exchange apparatus and a mounting component set for installation into storage tanks. The heat-exchange apparatus comprises a heat-exchanging component, a coupling manifold configured to engage with the heat-exchanging component, and a hollow, elongate, flow-directing element that delivers fluid to the heat-exchanging component. The mounting component set comprises an inner flange for engaging the inner wall of the storage tank, an outer flange for engaging the outer wall of the storage tank, and at least one gasket cooperable with one of the flanges. The heat-exchange apparatus sealably engages the outer flange such that the heat-exchanging component extends into the interior of the tank, and the coupling manifold is interconnectable to an external supply of heat-exchange fluid.

7 Claims, 10 Drawing Sheets

(51) Int. Cl.
*F28F 1/36* (2006.01)
*B21D 53/02* (2006.01)
*F28F 99/00* (2006.01)

(52) U.S. Cl.
CPC ..... *F28F 99/00* (2013.01); *Y10T 29/49833* (2015.01); *Y10T 29/49948* (2015.01)

(58) Field of Classification Search
USPC ..... 165/142, 185, 174
See application file for complete search history.

(56) References Cited

U.S. PATENT DOCUMENTS

| | | | | | |
|---|---|---|---|---|---|
| 2,299,307 | A | * | 10/1942 | Cornell | 508/110 |
| 4,293,323 | A | * | 10/1981 | Cohen | 62/238.6 |
| 4,452,233 | A | * | 6/1984 | Goodman | 126/653 |
| 4,633,819 | A | * | 1/1987 | Tilliette | 122/32 |
| 5,365,750 | A | * | 11/1994 | Greenthal | 62/293 |
| 5,390,500 | A | * | 2/1995 | White et al. | 62/50.2 |
| 5,749,242 | A | * | 5/1998 | Mowery | 62/347 |
| 2005/0139344 | A1 | | 6/2005 | Butler | |
| 2009/0218083 | A1 | * | 9/2009 | Arnot | 165/174 |

FOREIGN PATENT DOCUMENTS

| | | | | |
|---|---|---|---|---|
| GB | 1253025 | A | * | 11/1971 |
| WO | 2007137406 | | | 12/2007 |

* cited by examiner

HEAT-EXCHANGE APPARATUS FOR INSERTION INTO A STORAGE TANK, AND MOUNTING COMPONENTS THEREFOR

CROSS-REFERENCE TO RELATED APPLICATIONS

The present application is a national phase application under 35 U.S.C. § of International Patent Application No. PCT/CA2011/000784, filed Jul. 5, 2011, which claims priority to Canadian Patent Application No. 2,706,817, filed Jul. 5, 2010. The entire contents of these applications are incorporated by reference.

FIELD OF THE INVENTION

This invention relates to heat-exchangers. More particularly, this invention relates to heat-exchangers cooperable with mounting components for sealingly engaging storage tanks.

BACKGROUND OF THE INVENTION

Diesel-fuelled engines and/or hydraulic systems are frequently used in cold environments such as in the winter months in temperate zones or year round in far northern or southern geographies. The viscosities of diesel, hydraulic oils or other fluids increase significantly as ambient temperatures decrease to the point were they can form gels and/or waxes. In addition, cold conditions impede the transmission of thickened diesel fuel oils from their storage tanks to engines thereby interfering with and/or preventing engine starting. Smooth and safe operation of hydraulic-controlled attachments can also be adversely affected by cold-thickened hydraulic oil through reduced and impaired flow rates in response to manipulation of the hydraulic controls. Additionally, cold-thickened hydraulic oil imposes significant mechanical stresses on hydraulic pumps often resulting in accelerated wearing and deterioration of the pumps' components and periodically, in pump failure.

Large volumes of crude and refined petroleum products are commonly stored in bulk reservoir tanks at locations such as drilling sites, refineries, and storage depots. Transfer and transmission of such stored petroleum products can be significantly debilitated as their viscosities increase as a consequence of cold weather conditions.

Heat-exchange apparatus have been developed for installation in portable and/or fixed storage tanks for raising or lowering the temperatures of oil products stored therein as exemplified by U.S. Pat. Nos. 6,380,523; 5,423,373; 5,029,634; 4,926,830; 4,865,005; 4,726,346 and 4,237,850. However, numerous problems are associated with such prior art including complexity of design and associated high costs of production, variable and uneven heat-transfer profiles, and high energy input requirements for satisfactory performance. The heat-exchange apparatus described in WO2007/137406 overcomes many of these problems associated with the prior art devices, but despite its success, some issues remain. For example, the apparatus can be awkward to mount on a storage tank. Additionally, while the helical turbulator described in WO2007/137406 provides excellent performance, it is somewhat difficult to manufacture and must be precision engineered in a manner which is beyond the capacity of many engineering firms.

SUMMARY OF THE INVENTION

Some embodiments of the present invention relate to a heat-exchange apparatus comprising a heat-exchanging component, a coupling manifold configured to engage with the heat-exchanging component, and a hollow, elongate, flow-directing element that delivers fluid to the heat-exchanging component.

Some embodiments of the present invention relate to mounting components cooperable with the heat-exchange apparatus to sealingly engage the heat-exchange apparatus with a storage tank suitable for storing fluids, whereby a proximal section of the heat-exchange apparatus is sealingly engaged with the outer and inner walls of the storage tank and a distal section of the heat-exchange apparatus extends into the interior of the storage tank. An outer portion of proximal section of the heat-exchange apparatus is cooperable with a first mounting component that is substantially flush with the outer wall of the storage tank. A second mounting component that is substantially flush with the inner wall of the storage tank is cooperable with the first mounting component. The first and second mounting components are releasably interconnected by fixtures that sealingly fix the proximal portion of the heat-exchange apparatus to the inner and outer walls of the storage tank. The mounting components are also useful for sealingly engaging other devices and/or instruments with storage tanks and the like.

BRIEF DESCRIPTION OF THE DRAWINGS

The present invention will be described in conjunction with reference to the following drawings, in which.

DETAILED DESCRIPTION OF THE INVENTION

Figure 1:
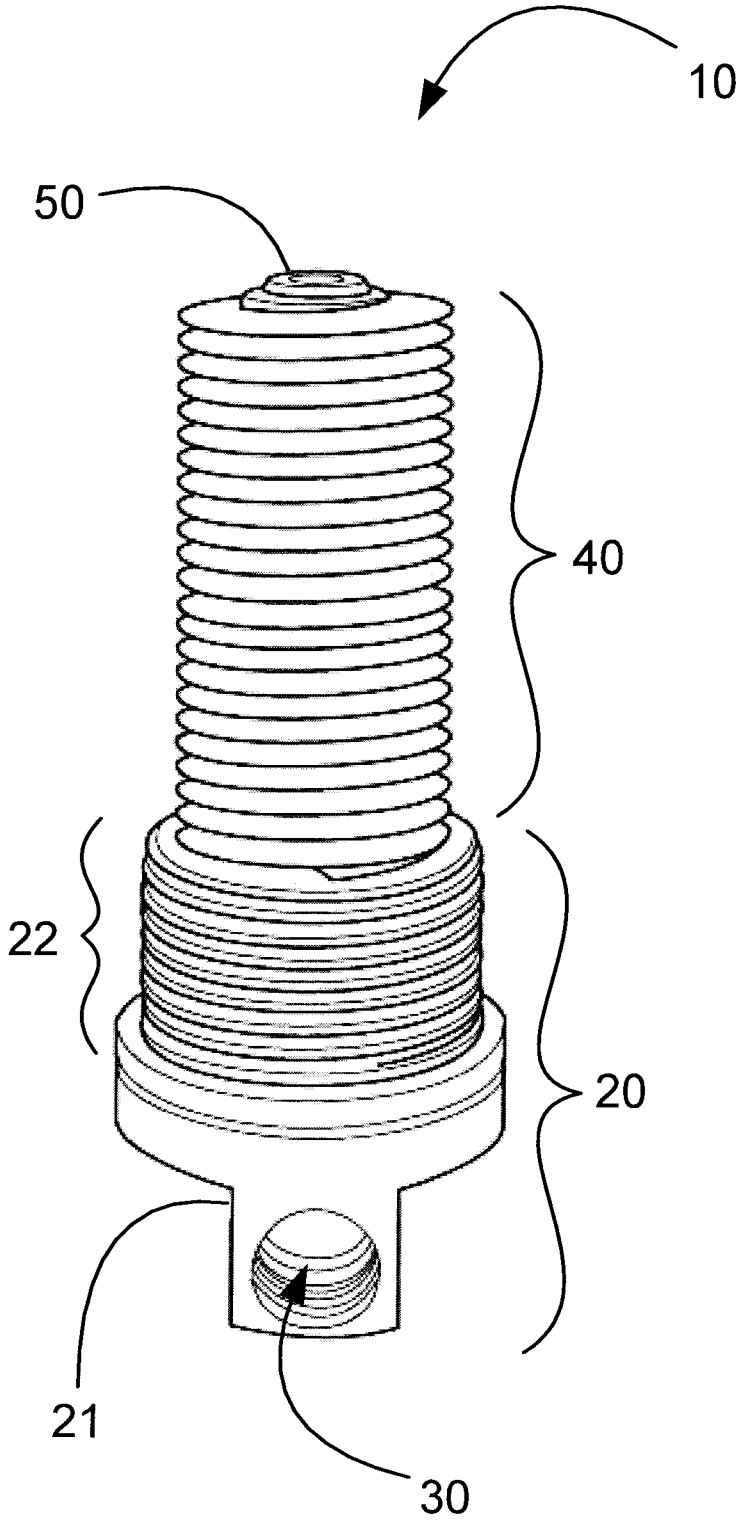
FIG. 1 is a perspective side view of an exemplary embodiment of an assembled heat-exchange apparatus of the present invention.

Exemplary embodiments of the present invention relates to a heat-exchange apparatus and to mounting components for sealingly engaging the heat-exchange apparatus with a storage tank wherein fluids may be stored.

An embodiment of the present invention relates to a heat-exchange apparatus comprising a heat-exchanging component, a coupling manifold interconnectable to a fluid supply and configured to engage with the heat-exchanging component, and a hollow, elongate, flow-directing element that delivers fluid to the heat-exchanging component.

The heat-exchanging component preferably comprises a void into which the flow-directing element delivers fluid. The void may be of any suitable size provided the flow-directing element can fit therein. Preferably the void is at least about 2 mm, more preferably at least about 5 mm, in diameter. Preferably the void is less than about 100 mm, more preferably less than about 50 mm, in diameter.

In a preferred embodiment the heat-exchanging component is elongated so as to extend into the storage area of a storage tank wherein fluids may be stored, so that the heat exchange component is at least partially immersed in the fluids, preferably completely immersed in the fluids. The heat exchange component is preferably substantially cylindrical but in certain embodiments may take a variety of forms depending on specific requirements. These forms include, but are not limited to, curved, looped, U-shaped and the like.

The heat-exchanging component is dimensioned of an appropriate size to fit the storage tank. In preferred embodiments the component is from about 1 cm to about 100 cm; more preferably from about 3 cm to about 90 cm; even more preferably from about 5 cm to about 60 cm in length.

The heat-exchanging component is made of a thermally conductive material. Preferably the material is at least somewhat resistant to any corrosive action of the stored fluids. More preferably the heat exchange component is made of a material selected from metals, thermally conductive plastics, ceramics, or combinations thereof. The exact material selected will depend somewhat on the fluids within which the heat exchange component will be immersed. Even more preferably the component is made of a material selected from aluminum, copper, brass, stainless steel, or the like.

The heat exchange component preferably comprises a heat-conducting conduit. In a preferred embodiment, the conduit may be provided on its exterior surface with a plurality of heat-conductive fins radiating outward from the conduit.

The distal end of the heat exchange conduit is sealably engaged with a plug component, or alternatively with a capping component. The plug device may be threadably engaged with the conduit. Alternatively, the plug device may be sealably engaged with the conduit by a compressive means, or optionally, by a process exemplified by brazing, welding and affixing with a polymeric adhesive.

The present heat-exchange apparatus comprise a flow-directing element. The flow-directing element carries heat-exchange fluid from the coupling manifold into the heat-exchanging component. The present flow-directing element is preferably contained within the heat-exchanging component such that two interconnected chambers are formed. The flow-directing element is preferably connected to an inlet port in the coupling manifold, and the interior chamber of the heat-exchanging component is preferably connected to an outlet port in the coupling manifold. Preferably, fluid flows from the inlet port, through the flow-directing element, into the interior chamber of the heat-exchanging component and out through the outlet port.

In a preferred embodiment the flow-directing element comprises a narrow tube that is arranged co-axially with the vertical axis of the heat-exchanging component. The flow-directing element preferably extends almost the entire length of the heat-exchanging component such that the flow is delivered to about the 'top' portion of the heat exchange component and then passes down through the length of the heat exchange component to exit via the outlet port at the base of the heat exchange component.

The interior wall of the heat-exchanging component and/or the exterior wall of the flow-directing element preferably comprise projections in order to perturb the flow in the chamber. This improves the heat-exchange capacity. In a preferred embodiment a helical vane or groove runs from through the chamber such that the heat-exchange fluid circulates through the chamber from top to bottom. The vane or groove may be on the interior wall of the heat-exchanging component but is preferably on the exterior wall of the flow-directing element.

The exemplary embodiments of the present invention are directed to a turbulated heat-exchange apparatus. The apparatus comprises a cylindrical heat-exchanging component, a coupling manifold configured to sealingly engage with one end of the heat-exchanging component and to cooperate and communicate therewith with the heat-exchanging component, and a flow-directing elongate insert configured to be axially positioned within the cylindrical heat-exchanging component.

According to one embodiment, there is provided a coupling manifold having a collar portion that defines a first bore extending into the body of the coupling manifold to form an inlet port that connects to the flow-directing element. The body of the manifold is provided with a second bore therethrough that connects to the inner chamber of the heat-exchanging component to form an outlet port.

According to one aspect, the collar portion is provided with an inward-facing female-threaded portion and an outward-facing male-threaded portion. In a suitable form, the outward-facing male-threaded portion is configured to threadably and sealably engage a threaded aperture provided therefore in a storage receptacle. Exemplary storage receptacles include tanks for storage of industrial oil products such as fuel oils, hydraulic oils, crude and refined petroleum oil products, plant-derived oils, animal-derived oils, and other types of industrial fluids such as glycols, water-based hydraulic fluids, and oil-field brines.

The inlet and outlet ports may be provided with inward-facing female threads configured for sealably engaging hose barbs. Alternatively, the inlet and outlet ports may be configured to interconnect with and sealably engage fluid transmission lines.

The body of the coupling manifold opposite the collar portion may be provided with two opposing notches thereby defining an outwardly extending section having two parallel and opposed flat edges that are engagable by the jaws of wrenching tools.

In an exemplary form, the turbulated heat-exchange apparatus is demountably engaged with an oil storage tank by threadably coupling the outward-facing male-threaded portion of the manifold collar with a threaded receptacle provided therethrough the storage tank. The inlet and outlet ports are sealably interconnected with fluid transmission lines controllably communicating with a pressurized supply of temperature-manipulated and temperature-controlled heat-exchange fluid. Pressurized temperature-controlled heat-exchange fluid ingressing the apparatus through the coupling manifold inlet port, is directed by the flow-directing element to the interior chamber of the heat-exchange conduit where heat exchange occurs as the pressurized fluid then flows through the chamber and egresses from the apparatus via the outlet port in the coupling manifold. In preferred embodiments the flow-directing element comprises fins or a helical vane (not shown) that cause the pressurized heat-exchange fluid to flow in a spiral pattern from the end of the flow-directing element toward the coupling manifold end of the heat-exchanging component. The spiral flow pattern facilitates a lengthened dwell time for the flow of the pressurized fluid through the heat-exchange chamber. Consequently an enhanced efficiency of heat transfer is provided.

An exemplary embodiment of the turbulated heat-exchange apparatus of the present invention is shown in the accompanying FIG. 1, and is generally referred to by the numeral 10. The device 10 comprises an elongate cylindrical heat-exchanging component 40 interconnected at one end with a coupling manifold 20 while the other end of component 40 is sealably engaged with a plug 50. The coupling manifold 20 comprises an inlet/outlet portion 21 that includes the inlet port 30 and the outlet port (not shown). The coupling manifold 20 is provided with a collar 22 having an outward-facing male-threaded coupling portion configured for threadably and sealably engaging a mounting element (not shown).

Figure 2:
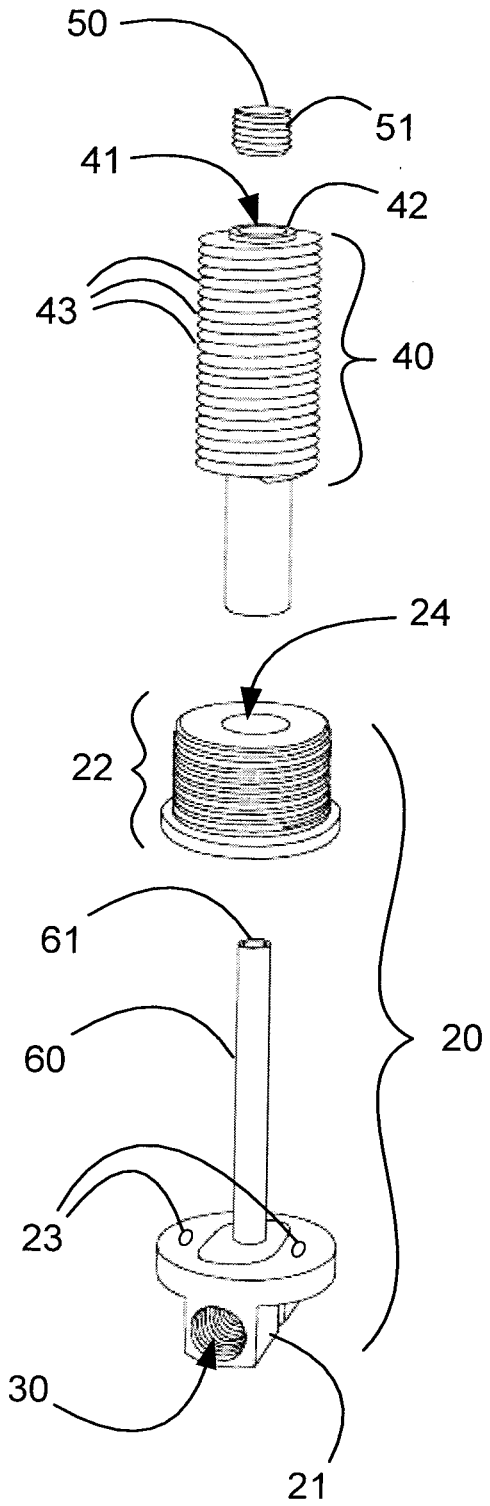
FIG. 2 is an exploded perspective side view of the heat-exchange apparatus shown in FIG. 1.

FIG. 2 shows a disassembled heat-exchange apparatus. The device comprises a coupling manifold 20 with an inlet/outlet portion 21 that includes the inlet port 30 and the outlet port (not shown). The coupling manifold 20 is provided with a collar 22 having an outward-facing male-threaded coupling portion configured for threadably and sealably engaging a mounting element (not shown). The collar comprises a void 24 for receiving the interior chamber 41 of the cylindrical heat-exchanging component 40. The heat-exchanging component 40 comprises fins 43 that radiate outwardly from the exterior surface and improve heat-exchange efficiency. It is within the scope of this invention to provide a heat-exchanging component 40 wherein the end 42 is preformed into a leakproof sealed end (not shown). The interior chamber 41 is designed to extend through and seal with the collar 22 but does not engage the inlet/outlet portion 21. The chamber 41 may be sealed with the collar 22 by means of press fitting, polymeric adhesives, or the like. The inlet/outlet portion 21 has two screw holes 23 that allow the inlet/outlet portion 21 to be fixed to the collar 22. A void 25 (shown in FIG. 3) is provided for insertion of an O-Ring (not shown) to ensure a good seal is formed between the inlet/outlet portion 21 and the collar 22. The inlet/outlet portion 21 also comprises the flow-directing element 60. The flow-directing element connects to the inlet port 30 and extends through the interior chamber 41 or the heat-exchanging component 40 to terminate in a aperture 61 close to the top 42 of the interior chamber 41. The interior chamber 41 is closed by means of plug 50 which is provide with threads 51 to threadably and sealably engage with the top 42 of the interior chamber 41. This arrangement allows heat-exchange fluid to enter through the inlet port 30, progress through the flow-directing element 60, exit through aperture 61 at the top 42 of the interior chamber 41, flow through the interior chamber 41 to exit through the outlet port (not shown). The flow-directing element 60 may be provided with spiraling vanes (not shown) on its exterior.

Figure 3:
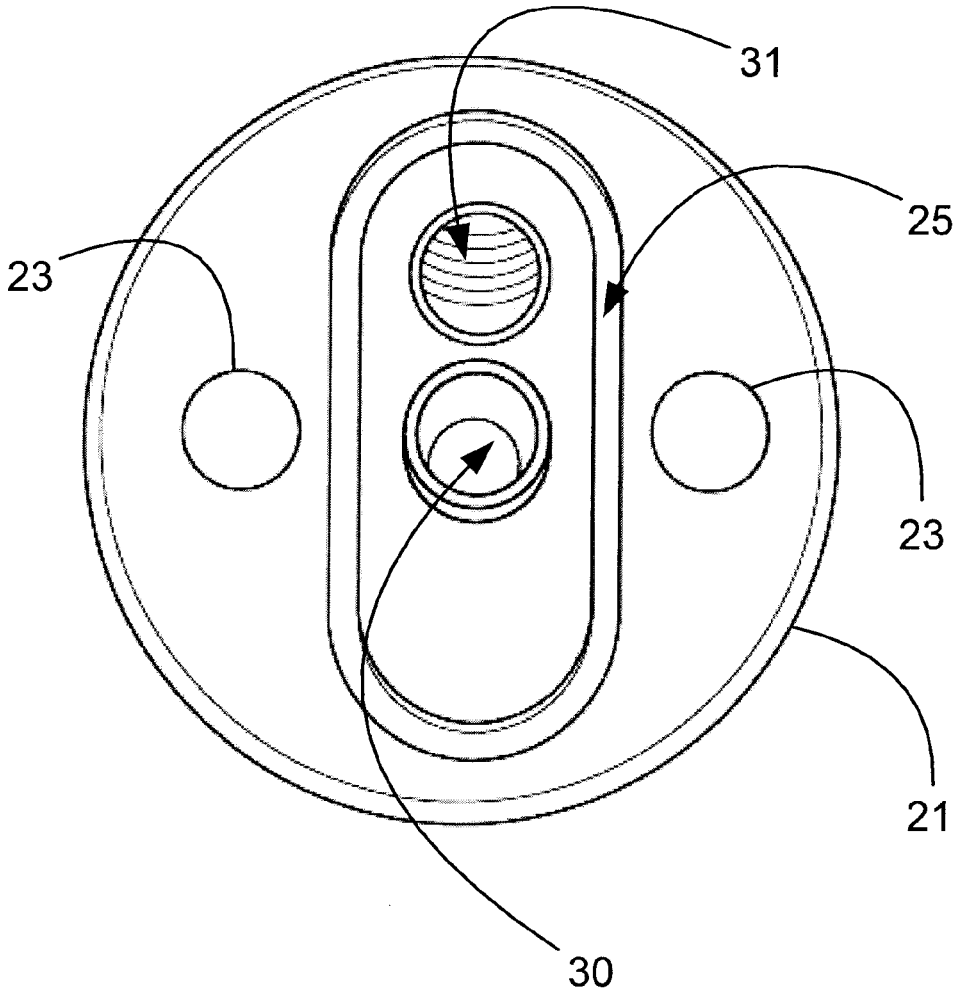
FIG. 3 is a cross-sectional end view of the inlet/outlet portion of the coupling manifold from FIG. 1.
Figure 4:
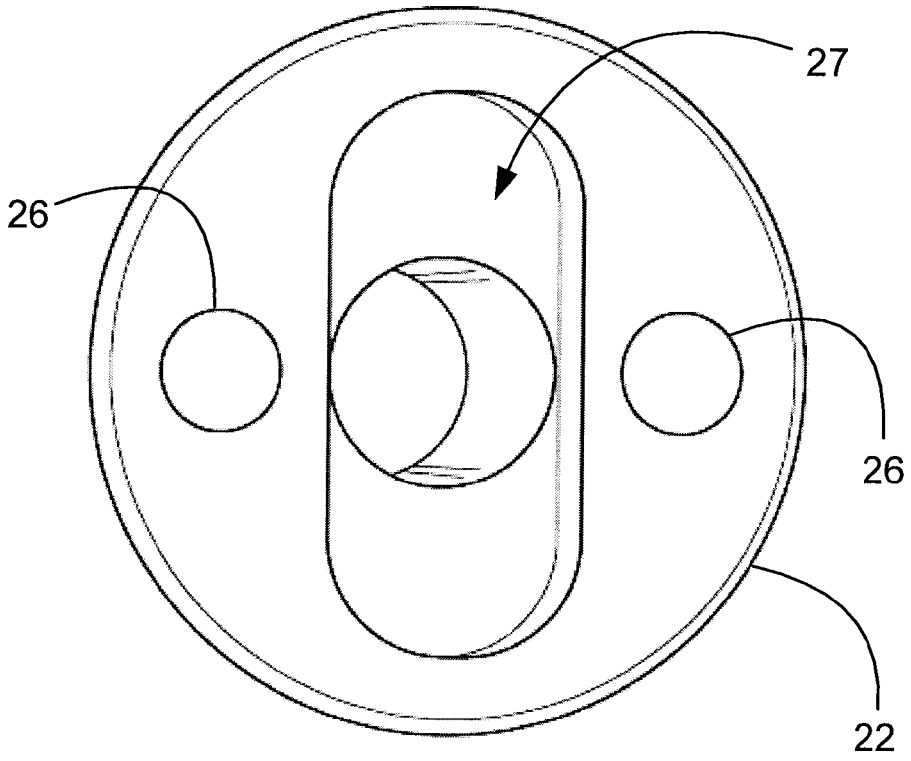
FIG. 4 is a cross-sectional end view of collar portion of the coupling manifold from FIG. 1.

Referring now to FIG. 3 and FIG. 4, we can see a top view of the inlet/outlet portion 21 (FIG. 3) and the collar 22 (FIG. 4). Two screw holes 23 are provided for fixing the portion 21 to the collar (not shown). The heat-exchange fluid enters the inlet port 30 which would be connected to the flow-directing element (not shown). The spent heat-exchange fluid exits through the outlet port 31. A void 25 is provided for insertion of an O-Ring (not shown) to ensure a good seal is formed between the inlet/outlet portion 21 and the collar (not shown). Two screw holes 26 are provided that correspond to the two holes 23 in the inlet/outlet portion 21. This allows the collar 22 to be fixed to the inlet/outlet portion 21. The collar 22 comprises a void 24 for receiving the interior chamber of the cylindrical heat-exchanging component (not shown). The collar also comprises a chamber 27 which allows the heat exchange fluid to collect before exiting through the outlet 31. The inlet port 30 and the outlet port 31 are preferably configured to sealably engage conventional hose barbs and/or fluid transmission lines commonly known to those skilled in these arts. It is to be noted that, if so desired, ports 30 and 31 may be configured identically so that either port may serve as an inlet port and the opposing port may serve as the outlet port.

The heat-exchanging component of the heat-exchange apparatus of the present invention is preferably configured to extend into storage tanks for direct contact with products stored therein while the coupling manifold of the heat-exchange apparatus protrudes from the external surface of the tanks and is easily accessible for installation and removal, for attachment to and disconnection from a pressurized supply of temperature-controlled heat-exchange fluid, and for inspections and service work as required. The heat-exchanging component is preferably mounted through the wall of the storage tank and sealably engaged with the wall via a mounting element.

As described above it is very desirable to add a heat-exchange apparatus to diesel, biodiesel, fuel oil or other types of storage tanks. However, there is a continuing issue with how to effectively and securely mount such devices. Prior art solutions involve significant time and effort while the results can be less than optimal. For example, they often require access to the interior of the tank which is not always possible and is often undesirable. GB382382 describes one method of mounting a pipe fitting to the side of a tank but this method is tricky and doesn't always provide a good seal. Therefore, a rapid and efficient method of mounting devices on tanks which resulted in less contamination and/or inconvenience would be a major benefit. The present invention includes sets of mounting components for sealably mounting devices, such as those exemplified by the heat-exchange apparatus of the present invention, through walls of tanks, pipes, containers, or other thin-walled vessels such as diesel tanks, hydraulic systems, waste pipes, industrial or agricultural process tanks, or the like.

An exemplary mounting component set generally comprises an inner flange, an outer flange, and a sealing gasket. The inner and outer flanges each have voids that are sized to a void provided on a wall of a tank for receiving there through a device such as those exemplified by the heat-exchange apparatus of the present invention.

The configuration of the interior flange allows quick and easy installation of the present mounting component set about the void provided in the wall of the tank in a very secure manner. The inner flange is provided with a gap extending from its outer edge to the void to enable insertion of the inner flange into the interior of the tank through the void provided in the wall of the tank.

The inner flange preferably comprises two or more attachment points. More preferably the inner flange comprises three or more, even more preferably four or more attachment points. These may be, for example, holes designed to accept a bolt or screw to pass through the tank wall. Or, preferably, they may be projections that can pass through the tank wall and be secured from the outer side. In a preferred embodiment the interior flange comprises a plurality of threaded projections that pass through pre-drilled holes in the tank wall and are secured from the outer side.

It should be noted that the interior flange may be inserted into the tank through pre-existing voids or a new appropriately sized void may be excised.

The interior flange of the present mounting component set is preferably made from a resilient material to enable it to be securely fixed in place and to resist deformation if torque is applied to the mount. Suitable materials include metals, plastics, and combinations thereof. Preferred materials include carbon steel, stainless steel, polyethylene, polypropylene, polytetrafluoroethylene, CPVC, polyvinylidene fluoride, titanium and alloys thereof, nickel alloys (e.g., Hastelloy®, Hastelloy is a trademark of Haynes International Inc., Kokomo, Id., USA), and suitable combinations thereof.

The interior flange and exterior flange are preferably fixed to one another. They may be fixed by any suitable means but are preferably bolted together with bolts or screws that pass through the wall. Alternatively, the flanges may be fixed together by bolts or screws that pass through the same void as the device.

A gasket may be placed between the exterior flange and the exterior wall of the tank in order to improve the seal, and optionally, between the interior flange and the interior wall of the tank. The gasket may be made of any suitable material but is preferably made from cork, plastic, or other deformable material that improves the seal. Preferred materials include cross-linked polyethylene (XLPE) closed cell foam, ethylene propylene diene M-class rubber (EPDM), Buna N rubber (Nitrile), fluoropolymer elastomers (e.g., Viton®, Viton is a registered trademark of Dupont Performance Elastomers LLC Ltd., Willmington, Del., USA), or the like. If required, extra sealant may be added to the mounting in order to ensure minimal leakage occurs.

The device to be inserted into the interior of the tank is preferably fixed to the exterior flange. Preferred means of fixing the device to the flange includes engaging with a polymeric adhesive, screwing, bolting, or combinations thereof. For example, the device may be provided with fixing elements comprising threads which can be engaged from the outer surface of the exterior flange with nuts having corresponding threads.

Some embodiments of the present invention relate to a mounting component set cooperable with the heat-exchange apparatus such as those exemplified herein, to sealingly engage the heat-exchange apparatus with a storage tank suitable for storing fluids, whereby a proximal section of the heat-exchange apparatus is sealingly engaged with the outer and inner walls of the storage tank and a distal section of the heat-exchange apparatus extends into the interior of the storage tank. An outer portion of proximal section of the heat-exchange apparatus is cooperable with a first mounting component that is substantially flush with the outer wall of the storage tank. An inner portion of the proximal section is cooperable with a second mounting component that is substantially flush with the inner wall of the storage tank. The first and second mounting components are releasably interconnected by fixtures that sealingly fix the proximal portion of the heat-exchange apparatus to the inner and outer walls of the storage tank.

Figure 5:
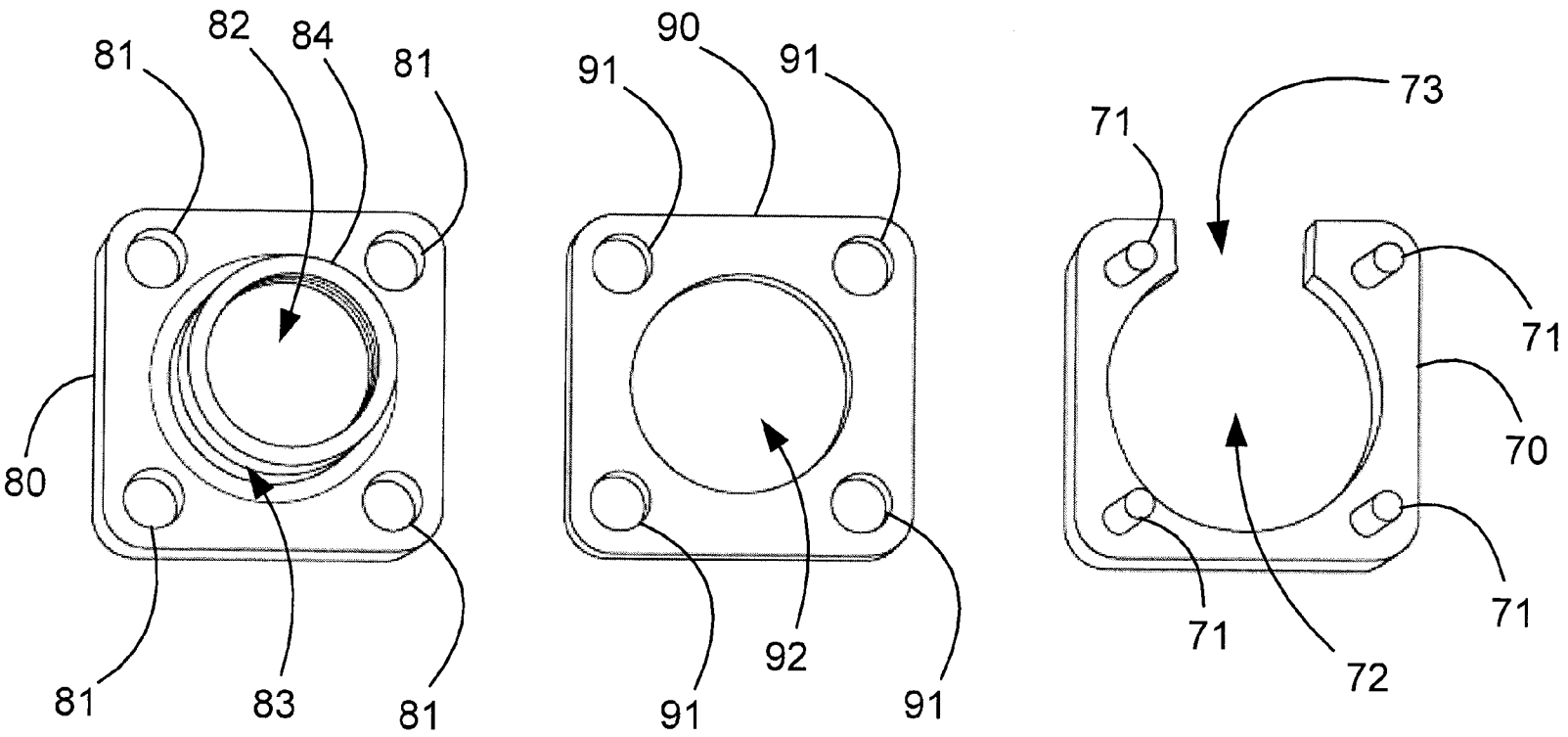
FIG. 5 is an exploded perspective side view showing an exemplary mounting component set of the present.
Figure 6:
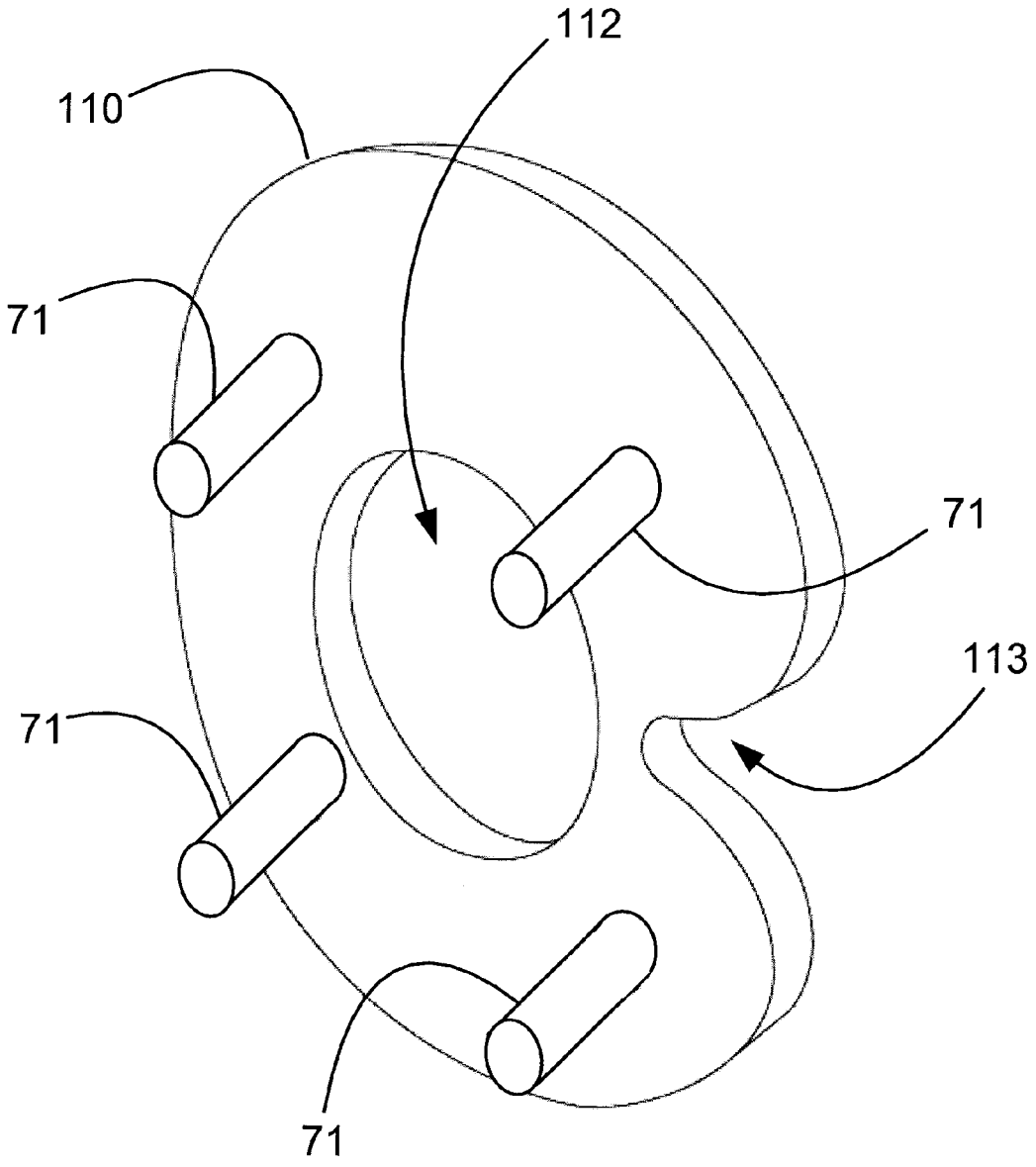
FIG. 6 shows an alternative embodiment of an interior flange.
Figure 7:
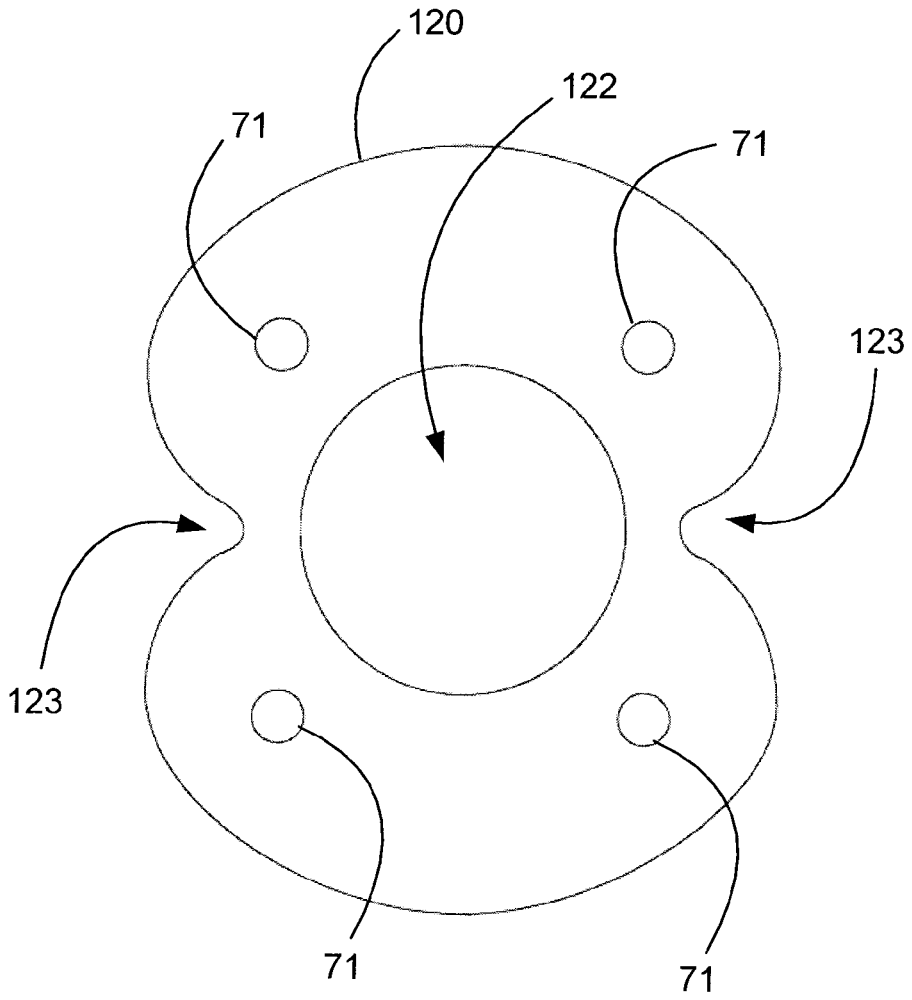
FIG. 7 shows another alternative embodiment of an interior flange.

FIG. 5 shows a disassembled exemplary mounting component set 65. An interior flange 70 comprises four fixing elements 71 that extend from the flange 70. The flange 70 defines a void 72 which is of an appropriate size to accept the device (not shown) to be mounted therethrough. The periphery of the inner flange 70 includes a gap 73 which allows the flange 70 to be inserted through a hole and into the tank (not shown). The fixing elements 71 are designed to extend through the side wall of the tank (not shown). FIG. 6 shows an alternative interior flange 110 having a notch 113 partially extending from the periphery of the flange 110 toward the void 112. Another exemplary interior flange 120 is shown in FIG. 7 wherein a plurality of notches 123 extends from the periphery of the flange 120 toward the void 122. Both exemplary interior flanges 110, 120 are provided with fixing elements 71 or alternatively are provided with threaded holes to cooperate with externally inserted fixing elements such as bolts or screws.

Referring again to FIG. 5, a flexible gasket 90 is provided for insertion between the outer wall of the tank (not shown) and the exterior flange 80 to ensure a better seal. The gasket 90 has voids 91 to accept the fixed elements 71. A void 92 is also provided to accept the device to be mounted (not shown). The exterior flange 80 has four voids 81 to accept the fixing elements 71. The exterior flange 80 defines a void 82 which is of an appropriate size to accept the device to be mounted (not shown). The exterior flange 80 comprises a collar portion 83 that comprises interior threads 84 to threadably and sealably engage the collar portion of the coupling manifold (not shown). The exterior flange 80 has holes 81 to accept the fixed elements 71.

Figure 8:
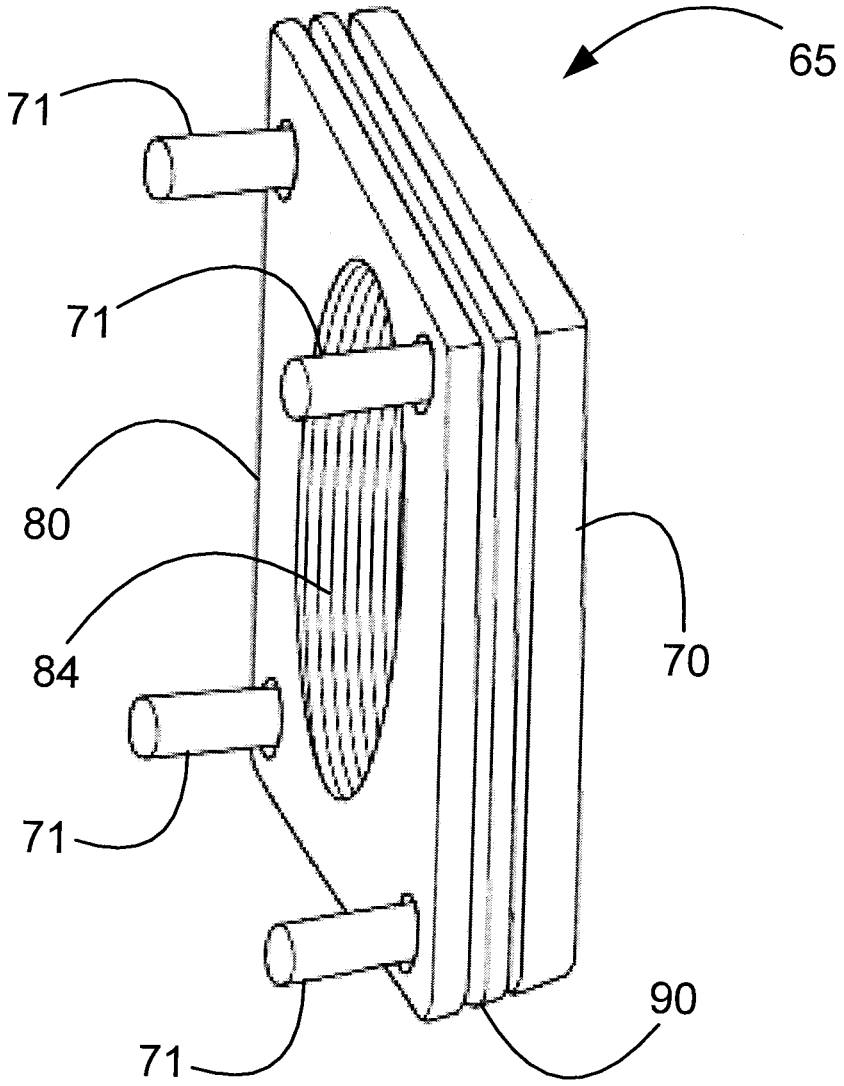
FIG. 8 is perspective side view of an assembled mounting component set.

FIG. 8 shows an assembled mounting component set 65. The interior flange's 70 fixing elements 71 extend through the gasket 90 and the exterior flange 80. The collar portion 83 (not visible in this view) extends through the void 72 (not visible in this view) has interior threads 84. The side wall of the tank (not shown) would pass between the washer 90 and the exterior flange 80.

Figure 9:
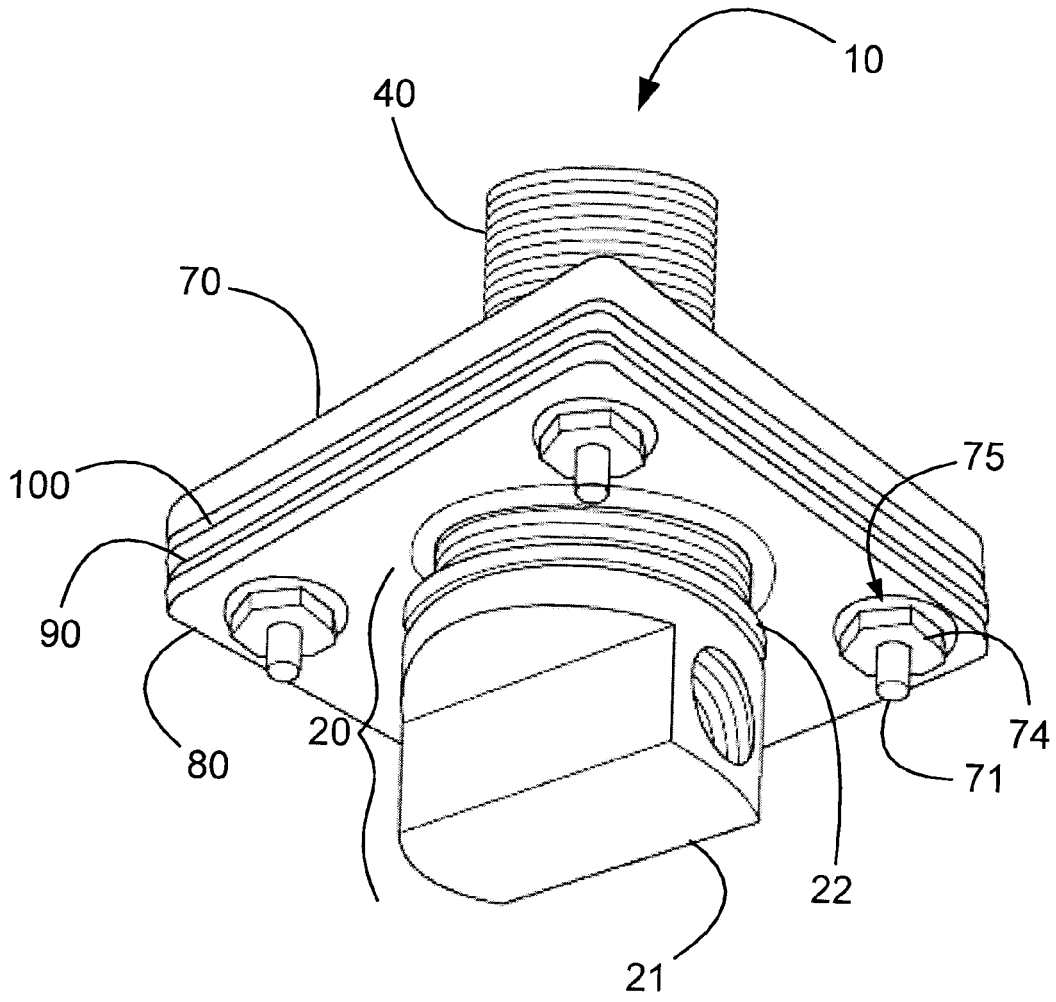
FIG. 9 is an external perspective side view of a mounted heat-exchange apparatus.

FIG. 9 shows the exterior of a heat-exchange apparatus 10 attached to a mounting component set 65. The coupling manifold 20 comprises the inlet/outlet portion 21 and the collar 22. The collar 22 is threadably and sealably engaged to the collar portion of the exterior flange 80. Installation of the heat-exchange apparatus into a storage tank generally follows the steps of: (1) inserting the interior flange 70 into the interior of the tank through a void provided therefore with the fixing elements 71 extending outward from the tank through the void; (2) placing the gasket 90 on the outer surface of the tank about the void; (3) installing the exterior flange 80 onto the external surface of the tank with the gasket 90 interposed therebetween, with the fixing elements 71 of the interior flange 70 extending through the apertures 91 of the gasket 90 and the apertures 81 of the exterior flange 90; (4) sealing engaging the interior flange 70 and exterior flange 80 to the tank by threadably engaging a nut 74 with each fixable element 71 with a washer 75 interposed therebetween until the nut 74 and fixable element are securely engaged; and (5) threadably and sealably engaging the collar 22 of the heat-exchange apparatus 10 to the collar portion 83 of the exterior flange 80.

Figure 10:
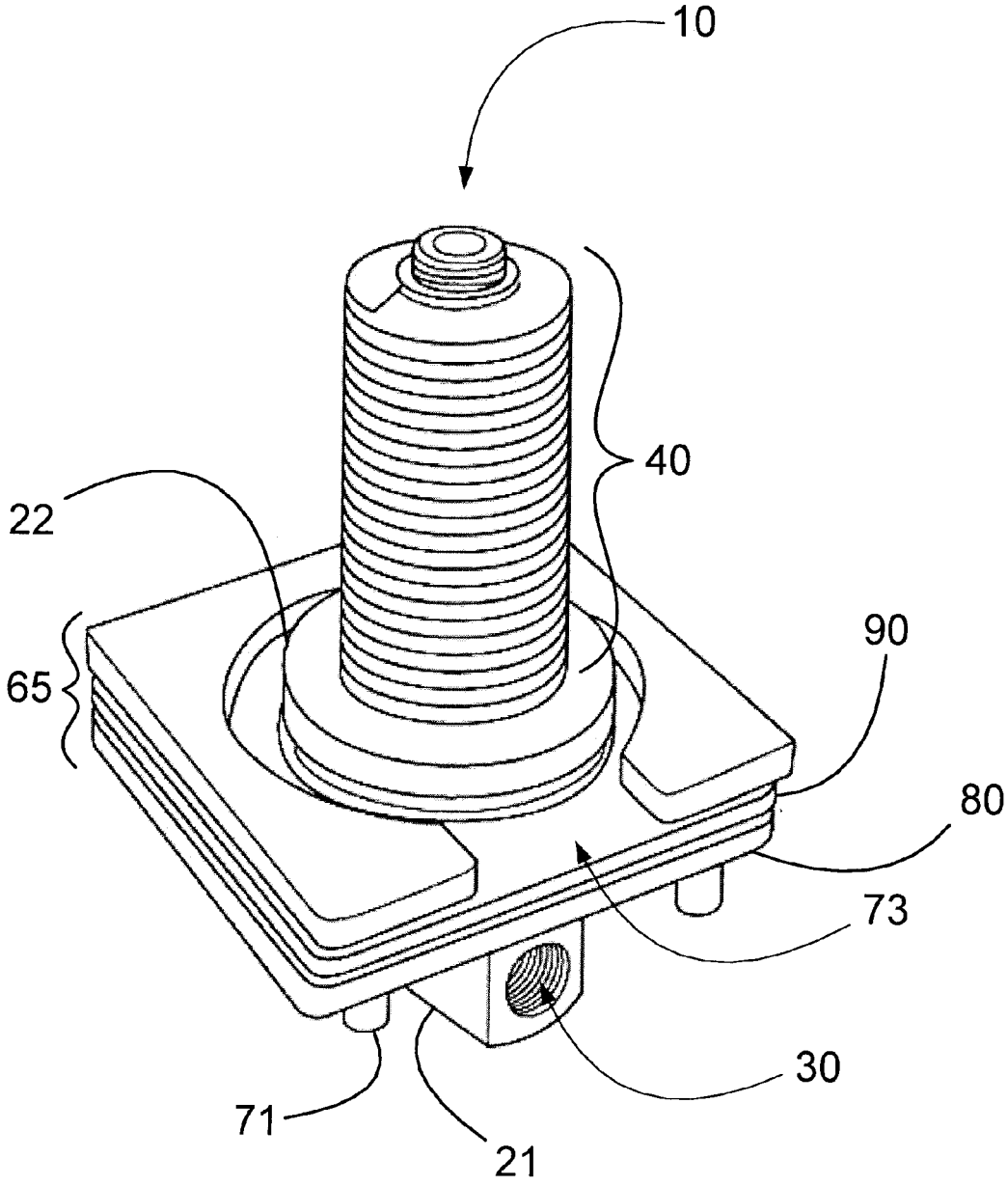
FIG. 10 is an internal perspective side view of a mounted heat-exchange apparatus.

FIG. 10 shows an interior view of a heat-exchange apparatus 10 mounted into a mounting component set 65 sealably engaged with a wall 100 of a storage tank (not shown). The heat-exchanging component 40 extends into the interior of the tank (not shown) through the exterior flange 80, the gasket 90, and the interior flange 70. The collar 22 is threadably and sealably engaged to the exterior flange 80. The gap 73 in the interior flange 70 allows it to be inserted through the side wall of the tank. The fixing elements 71 ensure the entire apparatus is secured in place.

After installation, the inlet port 30 and outlet port (not shown) are preferably interconnected to a pressurizable supply of heat-exchange fluid. The supply may comprise a fluid reservoir, a temperature-modifying/temperature-regulating component, a device for pressurizing said heat-exchange fluid, and fluid transmission lines interconnecting said supply and the apparatus 10 of the present invention. It is suitable for the inlet port and outlet port of the heat-exchange device to be to interconnected to one or more sealable quick-release engagement devices for communication with the pressurizable supply of heat-exchange fluid.

The heat-exchange apparatus 10 of the present invention is particularly useful for heating and thereby decreasing the viscosity of a cold-thickened oil product stored within a tank under cold weather conditions. In such situations, the heat-exchange fluid is isolated from the apparatus 10 and cycled within the pressurized supply system while it is heated to and maintained about a selected operating temperature, e.g., in the range of 85° C. to 99° C. It should be noted that the heat-exchange apparatus is suitable for cooperating with steam as the heat-exchange medium circulating there-through. The heated heat-exchange fluid is then controllably released under pressure from the transmission line through the quick-release engagement devices interconnecting the supply to the inlet port 30 of the coupling manifold 20 and enters the flow-directing element 60 where its flow is directed within and along the length of the heat-exchanging component 40 thereby facilitating the rapid and relatively even transfer and dissipation of heat from the pressurized heat-exchange fluid within the heat-exchanging component through the walls of the interior chamber 41 and heat-exchange fins 43 into the surrounding thickened oils, while minimizing the occurrence of hot and cold spots.

Those skilled in these arts will understand the individual components of the heat-exchange apparatus 10 of the present invention may be configured and tailored specifically for installation and use in different sizes and shapes of fuel tanks, hydraulic oil tanks and reservoir storage tanks, e.g., by changing: (a) the diameters and dimensions of the inlet and outlet ports 30 and 31, (b) the length, diameter and wall-thickness of the conduit 41, and (c) the thickness, spacing and outer diameter of the heat-exchanging fins 42. For installations into fuel tanks, it is preferable that the heat-exchange apparatus 10 is mounted in a horizontal axis in parallel with and near the bottom of the fuel tank. Alternatively, the heat-exchange apparatus may be mounted through the bottom of the tank with the heat-exchanging component 40 extending upwardly in a vertical orientation. For installations in closed-system hydraulic oil tanks communicating with hydraulic cylinders configured to manipulate tasking attachments, the heat-exchange apparatus 10 may be installed through the top of the tank with the heat-exchanging component 40 extending downwardly in a vertical orientation. Regardless of mounting orientation, the installed heat-exchange apparatus may be interconnected with a heat-exchange fluid transmission line communicating with the cooling system provided for the equipment's engine. Alternatively, the inlet port for receiving a heated heat-exchange fluid into the submersible heat-exchange apparatus may be configured for quick-release demountable engagement with transmission line communicating with a pressurized supply of heat-exchange fluid. Such a supply may be installed in and provided from a service building and may be configured to quick connect and disconnect with a plurality of mobile equipment provided with the submersible heat-exchange apparatus of the present invention. Alternatively, the supply may be mounted on and operable from a transportable equipment which may be driven to equipment provided with the submersible heat-exchange apparatus of the present invention.

The present invention is also suitable for installations in large reservoir tanks configured for storage of crude and refined petroleum products in refineries and depots, wherein the facilities' heating/cooling utilities can be configured to provide an in-house on-demand supply of pressurized temperature-controlled heat-exchange fluid for transmission to on-site storage tanks equipped with the heat-exchange apparatus.

Another exemplary embodiment of the presenting invention provides for mounting within a single tank, a plurality of interconnected heat-exchange apparatus of the present invention wherein the inlet port 30 of a first apparatus 10 is interconnected with the inlet port 30 of a second apparatus 10. The outlet port 31 of a first apparatus 10 is interconnected with the outlet port 31 of the second apparatus 10. This interconnecting method is applicable to any appropriate multiple of interconnected heat-exchange apparatus as application may dictate.

The present method may be used for installing all manner of devices, including but not limited to heat-exchangers, instrumentation sensors, gauges, fluid level indicating and control devices, flow-rate monitoring and control devices, temperature monitoring and control devices, and the like.

The present invention may be useful for: (a) increasing the temperature and/or reducing the viscosities of cold-affected stored oils, or (b) decreasing the temperature and increasing the viscosities of heat-affected stored fluids. It is within the scope of the present invention to install pressure and temperature measuring and/or recording and/or reporting devices that communicate with the inlet port and/or the outlet port of the coupling manifold.

While this invention has been described with respect to the preferred embodiments, it is to be understood that various alterations and modifications can be made to components and the applications of the apparatus and methods herein which will still fall within the scope of this invention.

What is claimed is:

1. A submersible heat-exchange apparatus comprising:

a coupling manifold comprising:

(i) an inlet/outlet portion having an inlet port and an outlet port, and (ii) a collar having an outward-facing male-threaded coupling portion for threadably and sealingly engaging a mounting assembly, said mounting assembly configured for sealingly engaging a sidewall of a fluid storage tank about a void provided therefor, the mounting assembly comprising:

a. an exterior flange having a continuous outer edge portion for sealingly engaging an outer portion of the sidewall, the exterior flange configured for sealingly engaging the collar, and b. an interior flange having a discontinuous outer edge portion for engaging an inner portion of the side wall, said interior flange provided with a plurality of through-wall fixing elements, wherein the exterior flange is configured to cooperate with the fixing elements;

an elongated heat-exchanging component comprising an interior chamber and having a proximal end and a distal end, wherein the proximal end is sealingly engaged with the collar portion in communication with the outlet port, and the distal end is a sealed end, said elongated heat-exchanging component provided with a plurality of spaced-apart outward extending heat-radiating vanes extending therealong; and a hollow flow-directing element sealingly engaging the inlet port and arranged co-axially within the interior chamber of the heat-exchanging component, the flow-directing element terminating in an aperture within the interior chamber;

wherein one of the interior chamber of the heat-exchanging component and the hollow flow-directing element is provided with a helical vane extending therealong, said helical vane projecting partially into the interior chamber.

2. The apparatus of claim 1, wherein the hollow flow-directing element terminates approximate the sealed end of the interior chamber.

3. The apparatus of claim 1, wherein the interior wall of the elongated heat-exchanging component is provided with an outward projecting helical vane therealong.

4. The apparatus of claim 1, wherein an exterior wall of the hollow flow-directing element is provided with an outward projecting helical vane therealong.

5. The apparatus of claim 1, wherein the inlet port and the outlet port are sealingly engagable with a supply of heated heat-exchange fluid.

6. The apparatus of claim 1, wherein the mounting assembly additionally comprises a gasket interposable the exterior flange and the outer portion of the sidewall.

7. The apparatus of claim 1, wherein the fluid storage tank is one of a fuel storage tank and an oil storage tank.

* * * * *